US005586679A

United States Patent [19]

Thomas

[11] Patent Number: 5,586,679

[45] Date of Patent: Dec. 24, 1996

[54] DISPOSABLE BODY CONTAINER

[75] Inventor: Betty M. Thomas, Joliet, Ill.

[73] Assignee: Group-J, Inc., Evergreen Park, Ill.

[21] Appl. No.: 106,648

[22] Filed: Aug. 16, 1993

(Under 37 CFR 1.47)

[51] Int. Cl.[6] ..... B65D 5/36; B65D 5/60; A61G 17/00

[52] U.S. Cl. ..... 220/410; 27/4; 27/11; 220/408; 229/117.07

[58] Field of Search ..... 220/408, 410, 220/462; 229/117.07, 117.08; 27/2, 3, 4, 11

[56] References Cited

U.S. PATENT DOCUMENTS

| | | | |
|---|---|---|---|
| 340,915 | 4/1886 | Hard | 229/117.08 |
| 1,535,188 | 4/1925 | Thompson . | |
| 3,574,906 | 4/1971 | Rittenhouse . | |
| 3,721,381 | 3/1973 | Locke | 229/117.16 |
| 3,729,786 | 5/1973 | Walding | 27/3 |
| 4,063,337 | 12/1977 | Havey, III . | |
| 4,123,831 | 11/1978 | Covington | 27/2 |
| 4,151,630 | 5/1979 | Havey . | |
| 4,156,956 | 6/1979 | Partridge et al. | 27/4 |
| 4,399,596 | 8/1983 | Parlour et al. . | |
| 4,891,869 | 1/1990 | Nutting | 229/23 R |
| 5,009,326 | 4/1991 | Reaves et al. | 220/410 |
| 5,201,868 | 4/1993 | Johnson | 220/410 |
| 5,307,545 | 5/1994 | Stoltz | 27/4 |

FOREIGN PATENT DOCUMENTS

| | | | |
|---|---|---|---|
| 619136 | 9/1980 | Switzerland | 27/3 |
| 133540 | 10/1919 | United Kingdom | 229/117.07 |

*Primary Examiner*—Gary E. Elkins
*Attorney, Agent, or Firm*—Patula & Associates

[57] ABSTRACT

A collapsible, disposable body container is disclosed for safely and sanitarily transporting, storing or disposing heavy, dense, fluid-containing contents such as a dead body. The container comprises a container base and a container lid which are foldable for transportation or storage. The container base is lined with a leak-proof, puncture-resistant, high-density polymer liner which prevents contact with or escape of the contents of the container when a user lifts the container via hand grips provided in the container. A container insert is placed over the lining to add strength to the container and to prevent the container from collapsing.

20 Claims, 4 Drawing Sheets

DISPOSABLE BODY CONTAINER

This invention relates to disposable body containers and, more particularly, to rigid containers made of foldable material for safely and sanitarily transporting, storing or disposing of dense, heavy contents, especially fluid-containing contents such as a dead body, container and all, if desired.

BACKGROUND OF THE INVENTION

Health consciousness, safety, environmental concerns and sanitation represent imperatives of modern society which have had increasing impact on numerous industries. The mortuary industry is no exception, consequently, there has been increased demand for improvements in the safe and sanitary transportation and cremation of dead bodies and of the transportation and/or disposal of heavy fluid-containing articles.

The prior art on caskets and coffins teaches a number of devices for improving the mortuary industry and the related health services industries through disposable caskets, most of which disclose use in association with cremation. In U.S. Pat. No. 3,574,906 issued to Rittenhouse, for example, a casket made of paperboard is disclosed and said to provide an easily burned, economical, easily stored and light weight device to replace the slow-burning wood casket, and the cumbersome and costly metal casket. Rittenhouse differs from the present invention in that Rittenhouse makes no provisions for the assembled casket to be collapsible into a folded position. Further, Rittenhouse utilizes separate handles, base plates, and anchor plates connected by nuts and bolts which greatly increases assembly time, and which elements would not burn during cremation.

In U.S. Pat. No. 4,151,630 issued to Havey, a disposable casket is disclosed which teaches an economical device for the display and cremation of the deceased. The device comprises bedding set in a casket bottom, with an outer casket shell placed over the casket bottom having viewing means to allow the deceased to be viewed for funeral services before cremation. The disposable casket can be made of cardboard for minimizing costs. Havey differs from the present invention in that Havey makes no provisions for the assembled casket to be folded completely in half. Further, Havey utilizes straps as handles and also provides for the use of hinges, glass, and shutters which greatly increase assembly time, and which elements, including staples and a zipper, would not burn during cremation.

U.S. Pat. No. 4,399,596 issued to Parlour, et al. also teaches a disposable coffin invention formed from a sheet of cardboard. This invention is compromised of a coffin base, sides and separate lid. Parlour, et al. differs from the present invention in that Parlour, et al. make no provisions for the assembled casket to be collapsible into a folded position. Further, Parlour, et al. does not provide hand grips or a fluid containing and gas impermeable lining.

Additionally, U.S. Pat. No. 4,063,337 issued to Havey, III discloses a casket invention intended to alleviate the high cost associated with funerals through a disposable casket. The invention is comprised of a bottom and sidewalls, and a casket shell which is configured to look like a conventional casket. The shell is removed after funeral services, and the container bottom and sidewalls are left containing the deceased, which body then is covered and sent to be cremated. Havey, III differs from the present invention in that Havey, III makes no provisions for the assembled casket to be folded completely in half. Further, the casket cover is not disposable and must be removed prior to cremation.

The present invention improves upon the prior art of disposable caskets in the configuration of the body container and, in particular, with the inclusion of a fluid-containing lining for maintaining proper sanitation and fumigation controls over a fluid-containing body stored within the container of the invention. The present invention also can be folded for convenience in transportation and storage. Therefore, it is a primary object of the invention to provide a disposable fluid-containing body container which retains fluids, vapors or other gaseous particles through a fluid and gas-impermeable container lining.

Another object of the present invention is to improve health services, sanitation and safety of transporting dead bodies through the use of a disposable-container lined with fluid and gas-impermeable means for preventing the exposure to or spreading of disease.

Another object of the present invention is to provide an improved disposable container for fluid-containing bodies which is lightweight, easy to manufacture and ship, easy to assemble, and is sturdy and capable of transporting dense, heavy bodies.

Still another object of the present invention is to provide an improved disposable container for fluid-containing bodies which is capable of being gripped and maneuvered easily.

Yet another object of the present invention is to provide an improved disposable casket capable of being used for dead body transport and cremation containment which is capable of being gripped and maneuvered easily without exposure to fluid or vapor contents of the body contained within, is economical to manufacture and is capable of being disposed of with diminished harmful environmental effects.

Numerous other advantages and features of the invention will become readily apparent from the detailed description of the preferred and alternative embodiments of the invention, from the claims, and from the accompanying drawings, in which like numerals are employed to designate like parts throughout the same.

BRIEF SUMMARY OF THE INVENTION

The present invention is a disposable body container for containing, transporting and, when necessary or desired, disposing of a fluid-containing body contained therewithin, container and all if so desired. The invention is comprised of foldable, rigid material formed into a container base having side walls and a plurality of hand grips, a liquid and gas impermeable lining covering the inside of the container base, an insert reinforcement placed on top of the container lining within the container, and a container lid having side walls and sized to fit over the container base and container base side walls.

BRIEF DESCRIPTION OF THE DRAWINGS

A fuller understanding of the foregoing may be had by reference to the accompanying drawings, wherein.

DETAILED DESCRIPTION OF THE INVENTION

Figure 1:
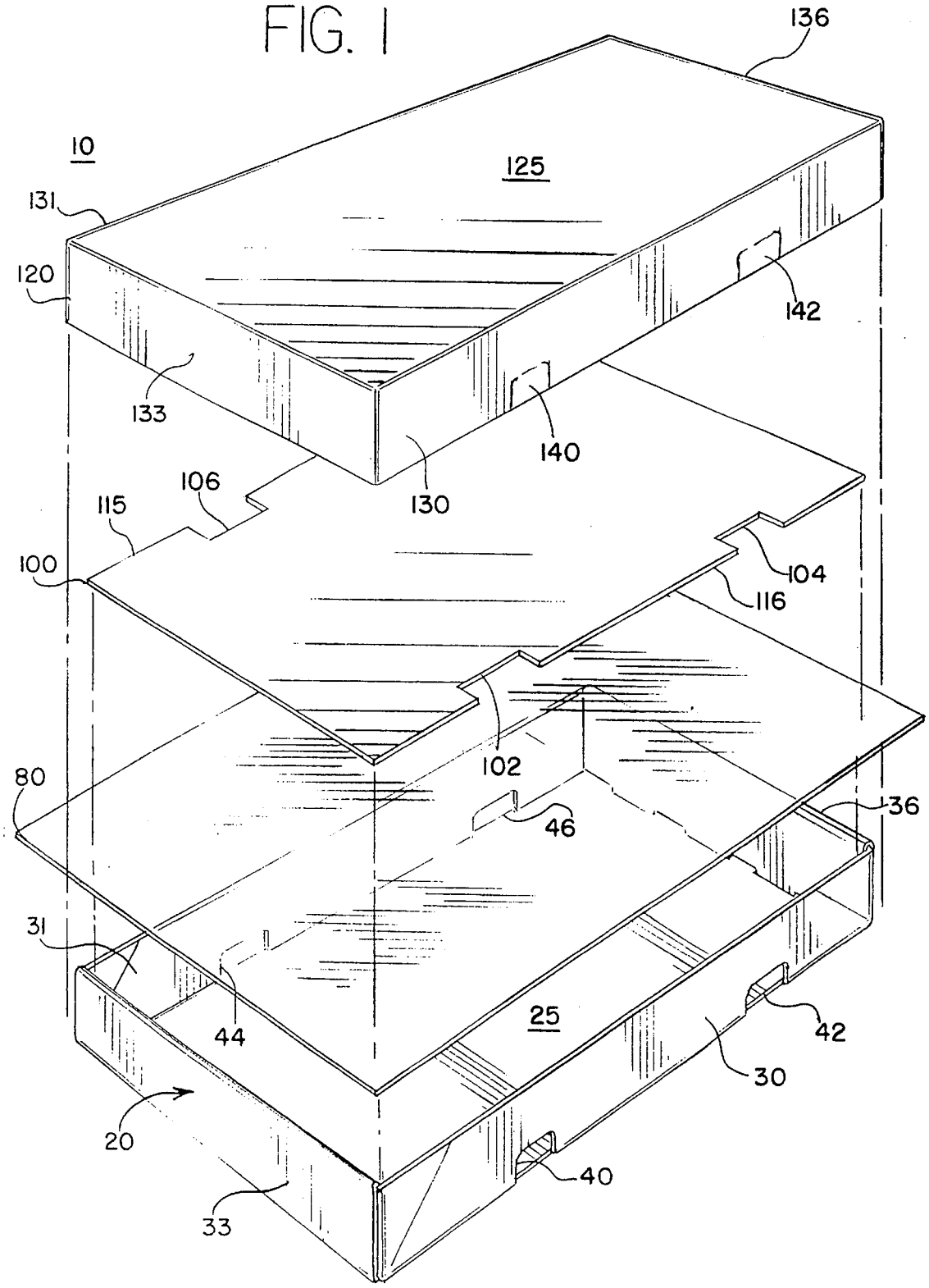
FIG. 1 is a perspective, exploded view of the disposable body container for fluid-containing bodies of the present invention, showing the container base, the container lining, the container base insert and the container lid, in its assembled, use-ready state.

While the invention is susceptible of embodiment in many different forms, there is shown in the drawings and will be described herein in detail, a preferred embodiment of the invention. It must be understood, however, that the present disclosure is to be considered an exemplification of the principles of the invention and is not intended to limit the spirit and scope of the invention and/or claims of the embodiment illustrated.

Referring now to FIG. 1, the preferred embodiment of the present invention there depicted is a disposable body container 10 for containing, transporting and, when necessary or desired, disposing of a fluid-containing body contained therewithin, container and all if so desired. In the preferred embodiment of the invention, foldable, rigid material forms the container 10 comprised of a container base 20, a liquid and gas impermeable lining 80 covering the inside of the container base 20, a container insert 100 placed on top of the container lining 80 within the container base 20 to reinforce the container base 20, and a container lid 120 being sized to fit over the container base 20.

Container base 20 comprises a container base panel 25, length side walls 30 and 31, width side walls 33 and 36, and a plurality of hand grips 40, 42, 44, and 46. Lining 80 is preferably a leak-proof, puncture resistant, high density polymer liner. Lining 80 is secured to container base panel 25 and length side walls 30, 31 and width side walls 33, 36, approximately half way up each side. Lining 80 should be of a large enough size to cover all of container base panel 25 and at least part of the walls, higher than the hand grips.

The container insert 100 is made to fit snugly into the bottom of base 20, over lining 80. Container insert 100 is a double corrugated insert which adds strength to the invention 10 and prevents invention 10 from collapsing from its assembled, use-ready state to its folded or semi-folded state. When extra strength is needed, additional inserts may be added, one on top of the other. Insert 100 has side lengths 116 and 115 with hand hold recesses 102, 104 and 106, 108 (not shown), respectively. Hand hold recesses are provided to allow hand grips 40, 42, 44, and 46 to be folded inward and downward and rest in the recesses.

Container lid 120 comprises a container lid panel 125, length side walls 130 and 131, width side walls 133 and 136, and a plurality of hand grips 140, 142, 144 (not shown), and 146 (not shown). Lid 120 is sized to securely fit over base 20. The hand grips 140, 142, 144, and 146 of lid 120 line up with the hand grips 40, 42, 44, and 46 of base 20, which line up with hand hold recesses 102, 104, 106, and 108 of insert 100.

Figure 2:
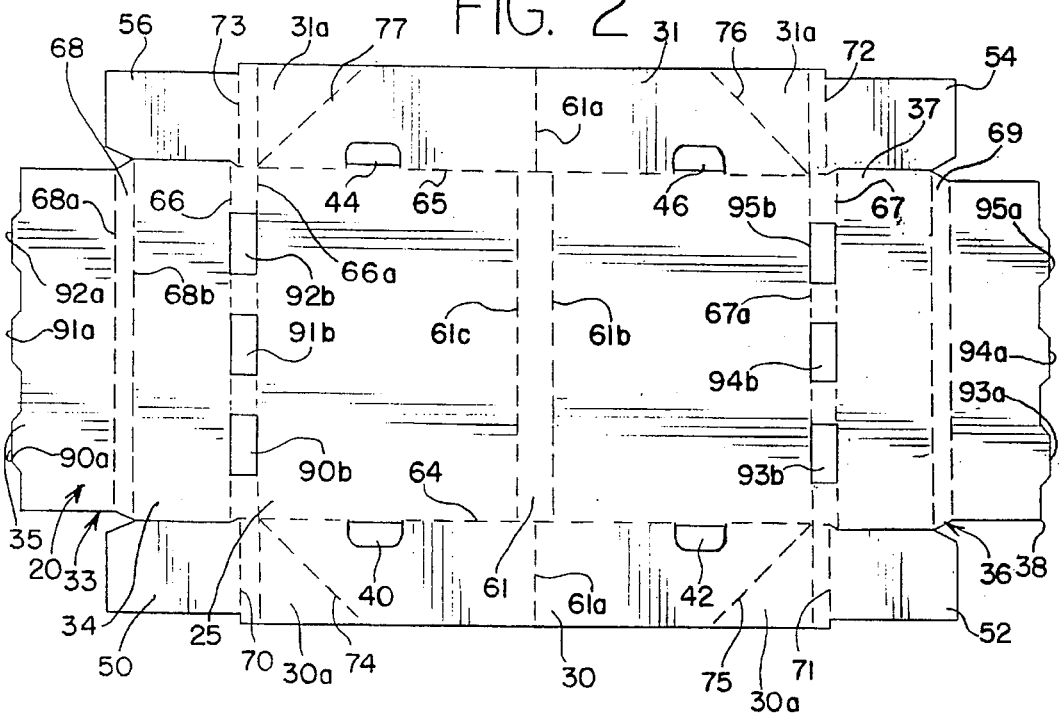
FIG. 2 is a top plan view of the container base of the present invention in its unfolded, unassembled state, showing the container base panel, hand grips and side walls in planar disposition.

FIG. 2 shows the preferred embodiment of the present invention container base 20 as a material blank in its unfolded, unassembled state. Unassembled container base 20 has a container base panel 25, length side walls 30 and 31 and width side walls 33 and 36. Length side walls 30 and 31 of container base 20 are formed upon lifting and folding side walls 30 and 31 along fold lines 64 and 65, respectively, inward toward container base panel 25, until perpendicular therewith. Hand grips 40 and 42 are formed along fold line 64 of side wall 30. Hand grips 44 and 46 are formed along fold line 65 of side wall 31.

Width side wall 33 is comprised of width side wall exterior 34 and interior locking flap 35, divided by fold 68. Fold 68 is defined by fold lines 68*a* and 68*b*, thereby allowing width side wall 33 to be sufficiently capable of folding over side wall corner reinforcements 50, 56 (as will be more fully described below). Interior locking flap 35 is further defined by locking tabs 90*a*, 91*a*, and 92*a*, with the container base panel 25 also having locking tab slots 90*b*, 91*b* and 92*b* cooperatively associated to lock with locking tabs 90*a*, 91*a* and 92*a*, respectively, upon lifting width side wall 33 and folding it inward toward container base panel 25 along fold line 66 until perpendicular therewith, then folding interior locking flap 35 inward toward container base panel 25 along fold 68.

Similarly, FIG. 2 also shows width side wall 36 having width side wall exterior 37 and interior locking flap 38, divided by fold 69. Fold 69 is defined by fold lines 69*a* and 69*b*, thereby allowing width side wall 36 to be sufficiently capable of folding over side wall corner reinforcements 52, 54 (as will be more fully described below). Interior locking flap 38 is further defined by locking tabs 93*a*, 94*a*, and 95*a*, with the container base panel 25 also having locking tab slots 93*b*, 94*b* and 95*b* cooperatively associated to lock with locking tabs 93*a*, 94*a* and 95*a*, respectively, upon lifting width side wall 36 and folding it inward toward container base panel 25 along fold line 67 until perpendicular therewith, then folding interior locking flap 38 inward toward container base panel 25 along fold 69.

Length side walls 30 and 31 are further defined by length side wall corner reinforcements 50, 52, 54 and 56. Each corner reinforcement 50, 52, 54 and 56 forms a corner of container base 20 upon being folded inward toward the interior face of side walls 30 and 31 until perpendicular therewith. Corner reinforcement 50 is folded along fold line 70, corner reinforcement 52 is folded along fold line 71, reinforcement 54 along fold line 72 and reinforcement 56 along fold line 73.

Container base 20 is formed into the storage unit of the present invention by folding corner reinforcements 50 and 52 inward toward the interior face of length side wall 30 along fold lines 70 and 71, respectively. Then, side wall 30 is lifted and folded inward toward the interior of container base 20 along fold line 64. Similarly, corner reinforcements 54 and 56 are folded inward toward the interior face of length side wall 31 along fold lines 72 and 73, respectively. Then, side wall 31 is lifted and folded inward toward the interior of container base 20 along fold line 65. It should be understood that corner reinforcements could be folded after the side walls are lifted.

While side walls 30 and 31 and corner reinforcements 50, 52, 54 and 56 are brought into generally perpendicular alignment with container base panel 25, and corner reinforcements 50 and 56 are aligned with fold 66, while corner reinforcements 52 and 54 are aligned with fold 67, width side walls 33 and 36 are then raised and folded toward container base panel 25 along folds 66 and 67, respectively. When exterior side wall 34 abuts corner reinforcements 50 and 56 in planar juxtaposition, and exterior side wall 37 abuts corner reinforcements 52 and 54 in planar juxtaposition, interior locking flap 35 of side wall 33 is folded inward toward container base panel 25 along fold 68, over corner reinforcements 50 and 56, and locked into place by inserting locking tabs 90*a*, 91*a* and 92*a* into locking tab slots 90*b*, 91*b*, and 92*b*, respectively. Similarly, interior locking flap 38 of side wall 36 is folded inward toward container base panel 25 along fold 69, over corner reinforcements 52 and 54, and locked into place by inserting locking tabs 93*a*, 94*a* and 95*a* into locking tab slots 93*b*, 94*b*, and 95*b*, respectively.

Figure 4:
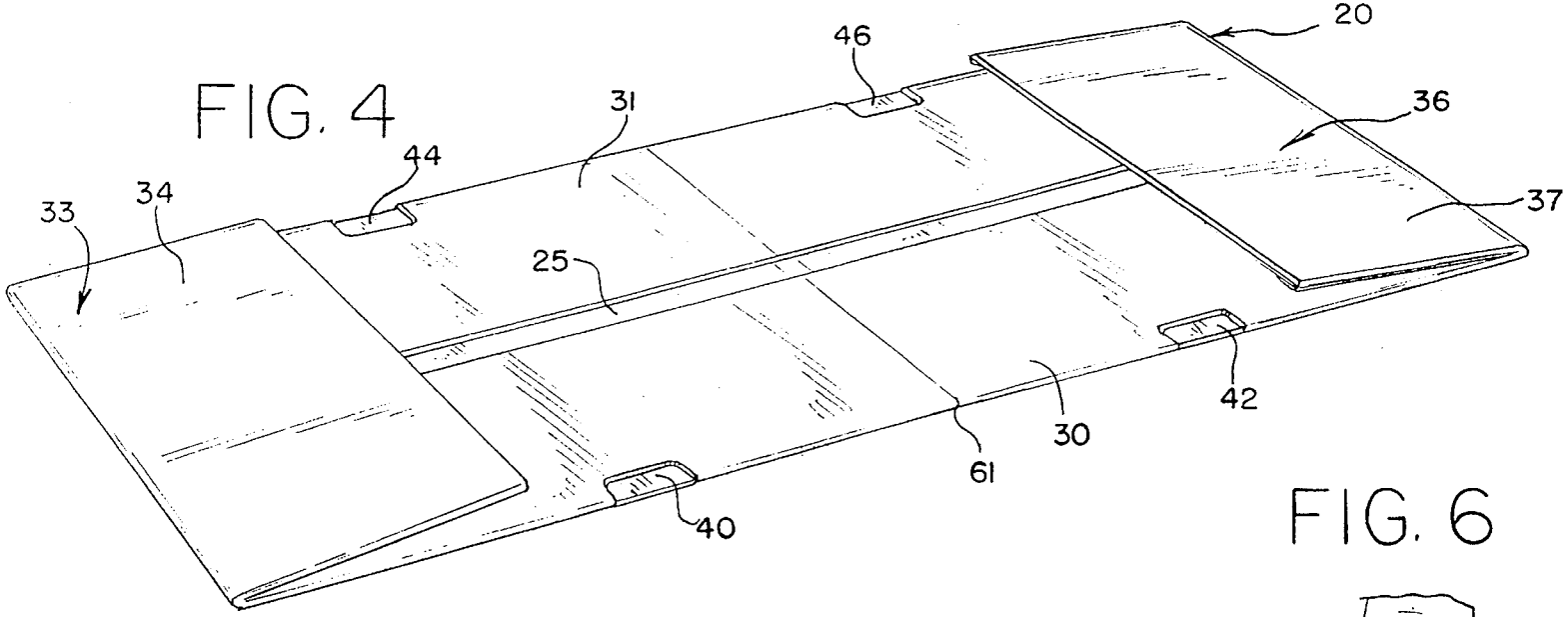
FIG. 4 is a perspective view of the container base of the present invention in its assembled and semi-folded state.
Figure 5:
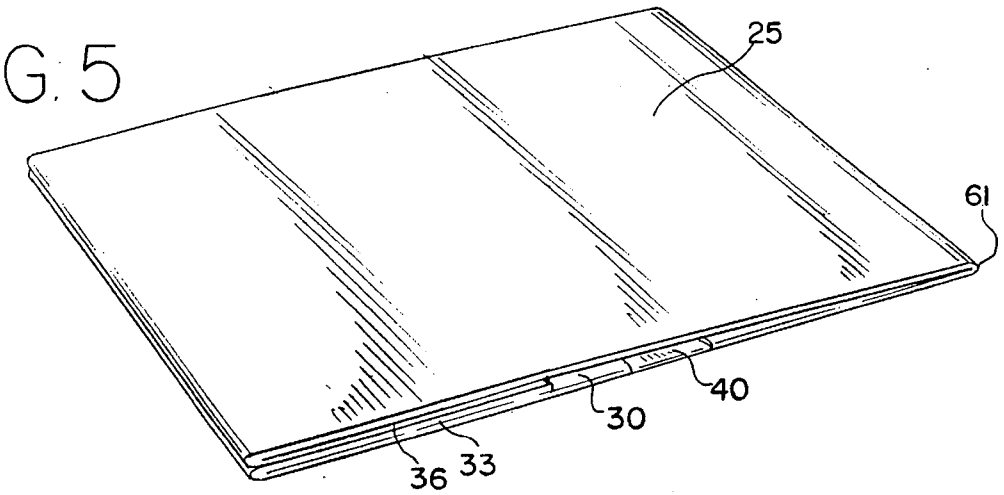
FIG. 5 is a perspective view of the container base of the present invention in its assembled and completely folded state for container shipping or storage when not in use for body containment.

Container base 20 is now in its assembled, use-ready position. The collapse of the assembled container base 20 along corner fold lines 74, 75, 76, and 77 flattens the container base 20 from its use-ready position into a generally planar, semi-folded configuration, as shown in FIG. 4. To collapse assembled container base 20, side walls 30 and 31 are pushed inward and downward toward container base panel 25. Angled fold lines 74, 75, 76, and 77 allow triangular sections 30*a* and 31*a* of side walls 30 and 31 to fold outward and downward, toward the exterior surface of side walls 30 and 31. At the same time, width side walls 33 and 36 fold inward and downward, along fold lines 66*a* and 67*a*, respectively, toward container base panel 25 and over side walls 30 and 31. Flattened container base 20 can then be folded in half along fold 61, into its completely folded position, for ready transportation and storage purposes, as shown in FIG. 5. Fold 61 is defined by fold lines 61*a*, 61*b* and 61*c*, thereby allowing container base 20 to be sufficiently capable of folding in half.

Figure 3:
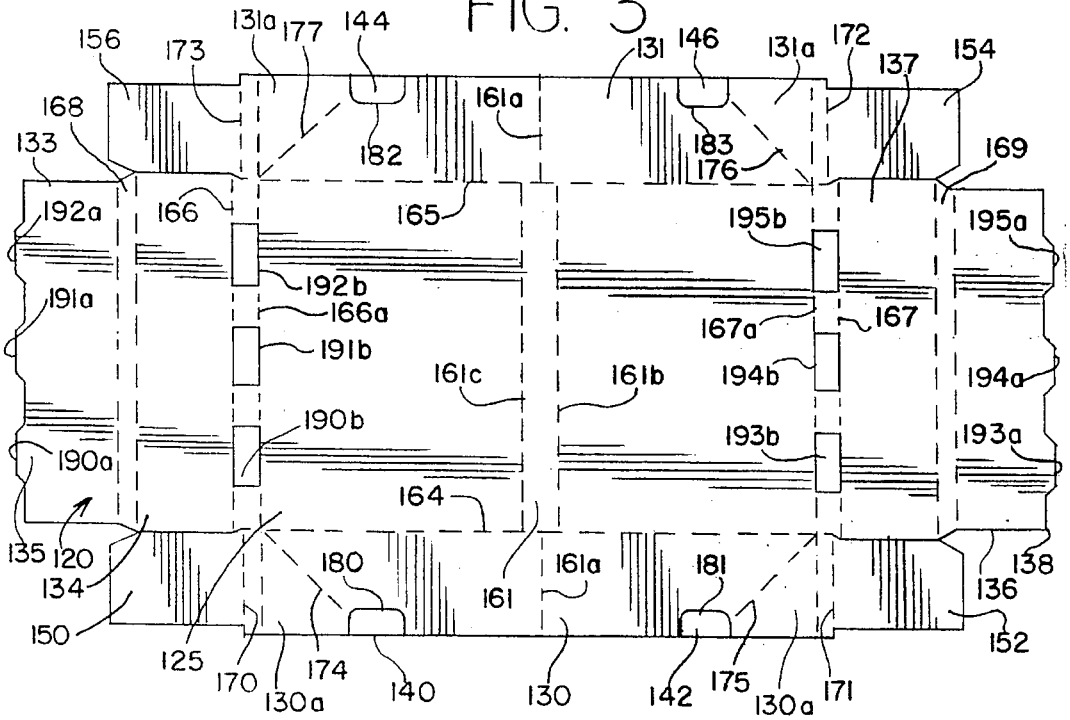
FIG. 3 is a top plan view of the container lid of the present invention in its unfolded, unassembled state, showing the container lid panel, hand grips, and side walls in planar disposition.

FIG. 3 shows, in the preferred embodiment of the present invention, container lid 120 as a material blank in its unfolded, unassembled state. Unassembled container lid 120 has a container lid panel 125, length side walls 130 and 131 and width side walls 133 and 136. Length side walls 130 and 131 of container lid 120 are formed upon lifting and folding side walls 130 and 131 along fold lines 164 and 165, respectively, inward toward container lid panel 125 until perpendicular therewith. Hand grips 140 and 142 are disposed on length side walls 130. Hand grips 144 and 146 are disposed on length side wall 131.

Width side wall 133 is comprised of width side wall exterior 134 and interior locking flap 135, divided by fold 168. Fold 168 is defined by fold lines 168*a* and 168*b*, thereby allowing width side wall 133 to be sufficiently capable of folding over side wall corner reinforcements 150, 156 (as will be more fully described below). Interior locking flap 135 is further defined by locking tabs 190*a*, 191*a*, and 192*a*, with the container lid panel 125 also having locking tab slots 190*b*, 191*b* and 192*b* cooperatively associated to lock with locking tabs 190*a*, 191*a* and 192*a*, respectively, upon lifting width side wall 133 and folding it inward toward container lid panel 125 along fold line 166 until perpendicular therewith, then folding interior locking flap 135 inward toward container lid panel 125 along fold 168.

Similarly, FIG. 3 also shows width side wall 136 having width side wall exterior 137 and interior locking flap 138, divided by fold 169. Fold 169 is defined by fold lines 169*a* and 169*b*, thereby allowing width side wall 136 to be sufficiently capable of folding over side wall corner reinforcement 152, 154 (as will be more fully described below). Interior locking flap 138 is further defined by locking tabs 193*a*, 194*a*, and 195*a*, with the container lid panel 125 also having locking tab slots 193*b*, 194*b* and 195*b* cooperatively associated to lock with locking tabs 193*a*, 194*a* and 195*a*, respectively, upon lifting width side wall 136 and folding it inward toward container lid panel 125 along fold line 167 until perpendicular therewith, then folding interior locking flap 138 inward toward container lid panel 125 along fold 169.

Length side walls 130 and 131 are further defined by length side wall corner reinforcements 150, 152, 154 and 156. Each corner reinforcement 150, 152, 154 and 156 forms a corner of container lid 120 upon being folded inward toward the interior face of side walls 130 and 131 until perpendicular therewith. Corner reinforcement 150 is folded along fold line 170, corner reinforcement 152 is folded along fold line 171, reinforcement 154 along fold line 172 and reinforcement 156 along fold line 173.

Container lid 120 is formed into the storage unit of the present invention by folding corner reinforcements 150 and 152 inward toward the interior face of length side wall 130 along fold lines 170 and 171, respectively. Then, side wall 130 is lifted and folded inward toward the interior of container lid 120 along fold line 164. Similarly, corner reinforcements 154 and 156 are folded inward toward the interior face of length side wall 131 along fold lines 172 and 173, respectively. Then, side wall 131 is lifted and folded inward toward the interior of container lid 120 along fold line 165. It should be understood that corner reinforcements could be folded after the side walls are lifted.

While side walls 130 and 131 and corner reinforcements 150, 152, 154 and 156 are brought into generally perpendicular alignment with container lid panel 125, and corner reinforcements 150 and 156 are aligned with fold 166, while corner reinforcements 152 and 154 are aligned with fold 167, width side walls 133 and 136 are then raised and folded toward container lid panel 125 along folds 166 and 167, respectively. When exterior side wall 134 abuts corner reinforcements 150 and 156 in planar juxtaposition, and exterior side wall 137 abuts corner reinforcements 152 and 154 in planar juxtaposition, interior locking flap 135 of side wall 133 is folded inward toward container lid panel 125 along fold 168, over corner reinforcements 150 and 156, and locked into place by inserting locking tabs 190*a*, 191*a* and 192*a* into locking tab slots 190*b*, 191*b*, and 92*b*, respectively. Similarly, interior locking flap 138 of side wall 136 is folded inward toward container lid panel 125 along fold 169, over corner reinforcements 152 and 154, and locked into place by inserting locking tabs 193*a*, 194*a* and 195*a* into locking tab slots 193*b*, 194*b*, and 195*b*, respectively.

Container lid 120 is now in its assembled, use-ready position. The collapse of the assembled container lid 120 along corner fold lines 174, 175, 176, and 177 flattens the container lid 120 from its use-ready position into a generally planar, semi-folded configuration. To collapse assembled container lid 120, side walls 130 and 131 are pushed inward and downward toward container lid panel 125. Angled fold lines 174, 175, 176, and 177 allow triangular sections 130*a* and 131*a* of side walls 130 and 131 to fold outward and downward, toward the exterior surface of side walls 130 and 131. At the same time, width side walls 133 and 136 fold inward and downward, along fold lines 166*a* and 167*a*, respectively, toward container lid panel 125 and over side walls 130 and 131. Flattened container lid 120 can then be folded in half along fold 161 into its completely folded position for ready transportation and storage purposes. Fold 161 is defined by fold lines 161*a*, 161*b*, and 161*c*, thereby allowing container lid 120 to be sufficiently capable of folding in half.

FIG. 4 illustrates assembled container base 20 in a semi-folded position. Length side walls 30 and 31 have been pushed inward and downward toward base panel 25. Width side walls 33 and 36 have been folded inward and downward toward base panel 25, over side walls 30 and 31. Container lid 120 (not shown) is placed in a semi-folded position in a similar manner.

FIG. 5 illustrates assembled container base 20 in a completely folded position. Container base 20, as shown in FIG. 4, is folded in half along fold 61 until width side wall 33 contacts width side wall 36. Container lid 120 (not shown) is placed in a completely folded position in a similar manner. Container base 20 and lid 120 are folded in this manner to be easily transportable and storable when not in use. Insert 100 (not shown) allows container 10 to be foldable without losing its strength to hold heavy bodies or other contents.

Figure 6:
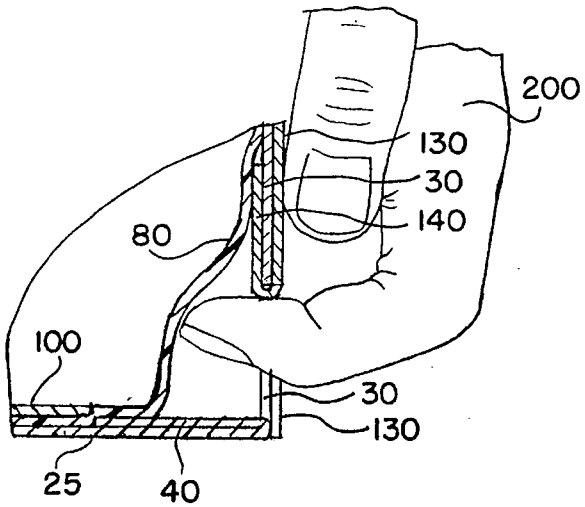
FIG. 6 is a partial side cross-sectional view of the container of the present invention being gripped by inserting a hand through a container base hand grip without piercing the container lining or being exposed to contained body fluids or vapors.

FIG. 6 illustrates the gripping of invention 10, while in use, at one of the hand grips, hand grip 40. All other hand grips are formed in a similar manner. Container base 20 is first unfolded into its use ready position. Lining 80 sits loosely therein, attached at the side walls. Hand grips 40, 42, 44, and 46 of container base 20 are then folded inward and downward along fold lines 64 and 65, pushing against lining 80 until contacting container base panel 25. Lining 80 falls back into place and covers hand grips 40, 42, 44, and 46. Container insert 100 is then placed into container base 20. Insert 100 securely entraps lining 80 between container base panel 25 and insert 100. Hand grips 40, 42, 44, and 46 fit within the hand hold recesses 102, 104, 106, and 108, with the lining 80 therebetween. After a body or other contents are placed in container base 20, on insert 100, container lid 120 is placed over base 20. Hand grips 140, 142, 144, and 146 are then folded inward and upward along fold lines 180, 181, 182, and 183 (FIG. 3), through the openings created in the base side walls when hand grips 40, 42, 44, and 46 were folded inward, until contacting the inner surface of container base side walls 30 and 31. As hand grips 140, 142, 144, and 146 are folded inward and upward, they push against lining 80 until contacting the interior surface of the side walls, at which time lining 80 falls back in place. Openings have thereby been created allowing a user to lift invention 10 by inserting a hand 200 therethrough, without contacting the contents or releasing vapors from the invention 10.

Figure 7:
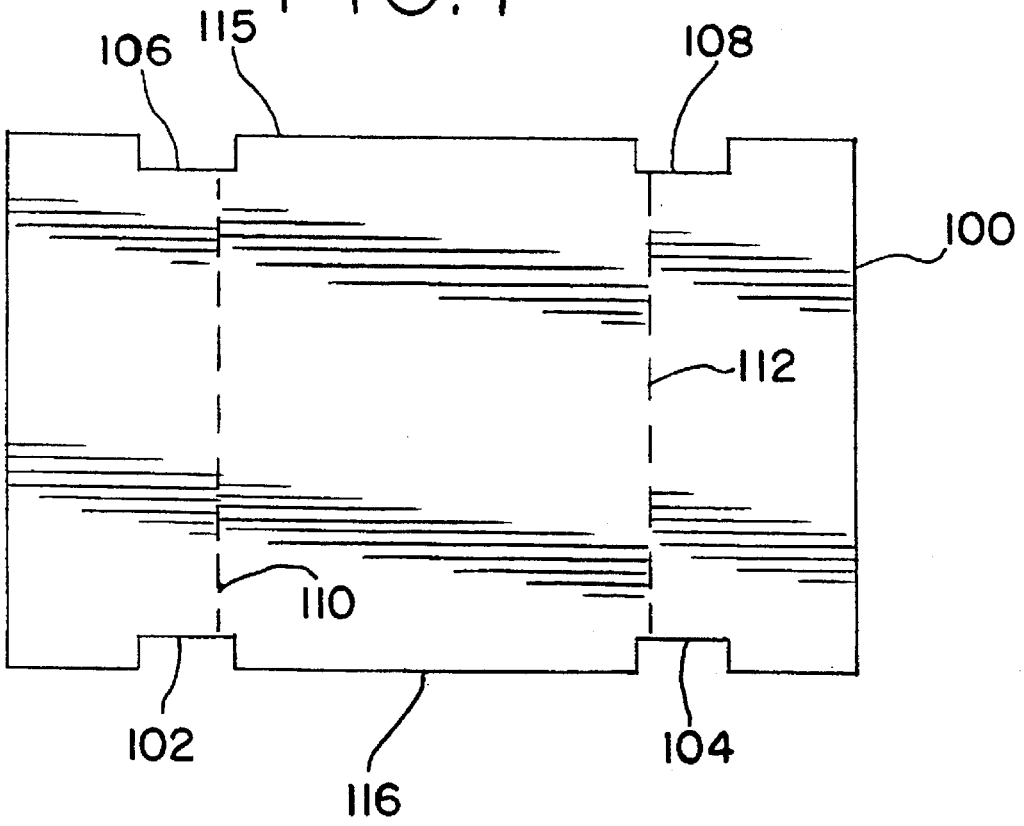
FIG. 7 is a top plan view of the container base insert of the present invention in its unfolded, use-ready state, showing the fold lines and hand grip indentations.

FIG. 7 shows the container insert reinforcement 100 having insert hand hold recesses 102 and 104 formed along length side 116, and hand hold recesses 106 and 108 formed along length side 115 to cooperatively associate with hand grips 40, 42, 44 and 46, respectively. Insert reinforcement 100 is further defined by fold lines 110 and 112, along which insert reinforcement 100 is folded for shipping purposes, and unfolded to be inserted into the container base 20 over the container lining 80 upon unfolding and use of the container 10.

After using container 10, and if desirable, the container 10 and its contents may be completely burned in a fire. All the materials of container 10 burn completely and environmentally. Even liner 80 burns rather than melts due to its low petroleum content. There are no nails, staples or other metals to cause clean up problems.

Container 10 is manufactured, assembled, and folded into its completely folded position before being shipped to or purchased by customers. Therefore, the user need only unfold container base, container lid, and insert into their use ready position, all of which take but a few seconds. This saves the user valuable time and the trouble of complicated assembly.

The container 10 may be tastefully decorated to present a dignified appearance. This pleasing, professional appearance can help prevent shock or insult to family members or loved ones of a deceased placed in the container.

The foregoing specification describes only the preferred embodiment and alternatives of the invention as shown. Other embodiments besides the ones shown and described may be articulated as well. The terms and expressions therefore serve only to describe the invention by example only and not to limit the invention. It is expected that others will perceive differences which, while differing from the foregoing, do not depart from the spirit and scope of the invention herein described and claimed.

I claim:

1. A collapsible, disposable body container, comprising:

a container base moveable along a plurality of fold lines between an open position defining a container, and a collapsed position defining a generally planar configuration; and a container lid sized to cover said container base;

said container base including a double center fold line for folding said container base in half longitudinally in said collapsed position.

2. The invention of claim 1, wherein said container base in the open position has a container base panel, at least two length side walls in generally parallel relation extending perpendicularly from said container base panel, and at least two width side walls in generally parallel relation extending perpendicularly from said container base panel.

3. The invention of claim 2, wherein said container lid is moveable along a plurality of fold lines between an open position, and a collapsed position defining a generally planar configuration.

4. The invention of claim 3, wherein said container lid in the open position has a container lid panel, at least two lid length side walls in generally parallel relation extending perpendicularly from said container lid panel, and at least two lid width side walls in generally parallel relation extending perpendicularly from said container lid panel.

5. The invention of claim 4, wherein said container base has a plurality of hand grips integrally formed therein.

6. The invention of claim 5, wherein disposed in said container base is an impermeable lining.

7. The invention of claim 4, wherein disposed in said container base in an open position is a container insert.

8. The invention of claim 6, wherein disposed in said container base in an open position is a container insert.

9. A collapsible, disposable body container, comprising:

a container base moveable along a plurality of fold lines between an open position defining a container, and a collapsed position defining a generally planar configuration; and a container lid moveable along a plurality of fold lines between an open position defining a cover, and a collapsed position defining a generally planar configuration, said container lid in the open position being sized to cover the container base.

10. The invention of claim 9, wherein said container base in the open position has a container base panel, at least two length side walls in generally parallel relation extending perpendicularly from said container base panel, and at least two width side walls in generally parallel relation extending perpendicularly from said container base panel, said at least two width side walls foldable along double fold lines to form two-ply width side walls in said open position.

11. The invention of claim 10, wherein said container lid in the open position has a container lid panel, at least two lid length side walls in generally parallel relation extending perpendicularly from said container lid panel, and at least two lid width side walls in generally parallel relation extending perpendicularly from said container lid panel, said at least two lid width side walls foldable along double fold lines to form two-ply lid width side walls in said open position.

12. The invention of claim 11, wherein said container base has a plurality of hand grips integrally formed therein.

13. The invention of claim 12, wherein disposed in said container base is an impermeable lining.

14. The invention of claim 9, wherein disposed in said container base in an open position is a container insert.

15. The invention of claim 11, wherein said at least two width side walls and said at least two lid width sidewalls include locking tabs cooperatively associating with locking tab slots in said container base panel and said container lid panel respectively in said open position.

16. A collapsible, disposable body container, comprising:

a container base moveable along a plurality of fold lines between an open position defining a container, and a collapsed position defining a generally planar configuration, wherein said container base in the open position has:

(i) a container base panel (ii) at least two length side walls in generally parallel relation extending perpendicularly from said container base panel (iii) at least two width side walls in generally parallel relation extending perpendicularly from said container base panel; and a container lid moveable along a plurality of fold lines between an open position defining a cover, and a collapsed position defining a generally planar configuration, said container lid in the open position being sized to cover the container base, said container lid having:

(i) a container lid panel (ii) at least two lid length side walls in generally parallel relation extending perpendicularly from said container lid panel; and (iii) at least two lid width side walls in generally parallel relation extending perpendicularly from said container lid panel; and an insert member moveable along a plurality of fold lines between an open position defining a container base insert, and a collapsed position defining a generally planar configuration;

said disposable body container being entirely combustible.

17. The invention of claim 16, wherein said container base and said container lid each have a plurality of hand grips integrally formed therein and aligning at said container base panel upon said container lid covering said container base.

18. The invention of claim 17, wherein disposed in said container base is an impermeable lining attached to said two width sidewalls and said two length sidewall above said plurality of hand grips and entirely covering said container base panel.

19. The invention of claim 18, wherein said container base insert is positioned over said impermeable lining in said container base in an open position.

20. The invention of claim 17 wherein said plurality of hand grips include movable flaps, said movable flaps in said container base being displaced to form openings in said length sidewalls, said openings defining a top perimeter, said moveable flaps in said container lid being displaced around said top perimeter of said openings upon alignment of said plurality of hand grips to form three-ply handle grips.

* * * * *